United States Patent [19]

Wright

[11] Patent Number: 4,862,611

[45] Date of Patent: Sep. 5, 1989

[54] PORTABLE, DOOR-HANGING IRONING BOARD

[76] Inventor: Margaret J. Wright, 5876 Dana Dr., Norcross, Ga. 30093

[21] Appl. No.: 122,762

[22] Filed: Nov. 19, 1987

[51] Int. Cl.[4] ..... A47B 5/00; D06F 81/06

[52] U.S. Cl. ..... 38/103; 38/140; 38/139; 108/38; 108/48; 248/214

[58] Field of Search ..... 38/103, 140, 139, 135, 38/104, 137; 248/214, 240.4, 293; 211/116, 118, 150; 108/47, 48, 134, 139, 108, 38

[56] References Cited

U.S. PATENT DOCUMENTS

| | | | |
|---|---|---|---|
| 817,596 | 4/1906 | Siebenthal | 108/48 |
| 1,124,218 | 1/1915 | Foss et al. | 38/104 |
| 1,732,782 | 10/1929 | Wasmuth | 108/38 |
| 1,790,468 | 1/1931 | Frank et al. | 108/38 |
| 2,464,570 | 3/1949 | Galbraith | 38/140 |
| 3,780,971 | 12/1973 | De Filipps | 248/214 X |
| 3,965,588 | 6/1976 | Long | 38/103 |
| 4,480,556 | 11/1984 | Wilson et al. | 38/103 X |
| 4,662,629 | 5/1987 | Plovie | 248/214 X |
| 4,779,539 | 10/1988 | Stiglich | 108/48 |

FOREIGN PATENT DOCUMENTS

| | | | |
|---|---|---|---|
| 2466217 | 4/1981 | France | 108/48 |

*Primary Examiner*—Andrew M. Falik

*Attorney, Agent, or Firm*—Harry I. Leon

[57] ABSTRACT

An ironing board having a mounting frame with a hook that allows the ironing board to be hung from the top of a door without any permanent fasteners. All the weight of the device is taken on the hook, and only a small side force caused by the motion of an iron across the surface of the board needs to be accounted for. A pair of suction cups mounted on the frame and applied to the door surface are provided to handle this side force. To support the surface board, which is pivotally mounted on the frame, each of a pair of braces is slideably connected to the frame and pivotally connected to the surface board. The frame, the surface board and the braces together form a pair of three-sided structures for supporting the surface board while it is extended in use. For transport and storage, the ironing board can be folded inside of its frame, minimizing the space taken up by the device and protecting the board from damage. When extended in use, the ironing board occupies wasted space which must be left vacant in a room to allow the door to be swung open. The underside of the surface board lacks any obtrusive support legs, allowing even a person confined to a wheel chair to utilize it. The design allows a unique ironing board cover to be utilized. The cover, which is slipped over the free end of the board like a glove, offers interchangable top and bottom surfaces, thereby doubling the life of the cover.

6 Claims, 2 Drawing Sheets

PORTABLE, DOOR-HANGING IRONING BOARD

BACKGROUND OF THE INVENTION

This invention relates to the field of folding ironing boards that are easy carried and stored. The convenience of having a foldable ironing board mounted on a wall has long been recognized. In the year 1915, both Foss and Mayberry in U.S. Pat. No. 1,124,218 and Hornschuch in U.S. Pat. No. 1,136,878 disclosed ironing boards so mounted. Later Fay in 1942, U.S. Pat. No. 2,298,002, and Larsen in 1957, U.S. Pat. No. 2,814,892, improved upon these earlier ironing boards; but, like their predecessors, they taught devices which required permanent wall supports. Also, each of the inventors in the cited prior art used bracing for the board that forms a rather thick, bulky package when the board is folded so that even if these ironing boards were made portable, they would be very difficult to carry.

Porter, U.S. Pat. No. 1,793,826, and Rasmussen, U.S. Pat. No. 2,386,139, on the other hand, each mounted an ironing board upon a closet door. Their boards, which were hung from a single handle on a closed closet door, placed a severe stain on its handle.

Leemhuis, U.S. Pat. No. 3,680,235, invented an ironing board that fits on both of the door handles of a closet or other door. The board is supported by a pair of hooks placed over the handles and a heel that rests against the door edge. In order to use this board, however, the closet door needs to be held open by blocks placed on each side of the door. Therefore, not only does this board fail to use the wasted space of the door swing but also the board places a severe load on the support shaft of the door handles which must both support the weight and resist the bending moment of the board in use.

SUMMARY OF THE INVENTION

The ironing board of this application answers the need of our mobile society for a portable ironing board that is lightweight, easy to carry and to set up and requires little space to use and store. According to the invention, the ironing board comprises a frame that has a pair of spaced vertical angle sections, a surface board pivotally attached to and braced at the lower end of the frame, and an elongated support hook attached to the upper end of the frame. The support hook allows the frame to be hung from the top of a suitable door for use while ironing or for storage. The spacing and orientation of the vertical angle sections are such that they cradle the surface board when it is in the folded position and protect it from damage in storage or transport. When the surface board is extended in use, it is supported in part by the frame at the pivotal attachment and in part by a pair of braces pinned to the surface board near this pivotal attachment; the other end of each brace, which is contiguous the frame, has a pin which moves slideably in a slot at the lower end of the frame and reaches its full travel when the surface board is disposed horizontally. The braces are relatively short, but effective, and completely eliminate the need for any structure under the extended surface board.

In view of the foregoing, the object of the invention is to provide an ironing board which can be instantly placed in service anywhere there is a closet or other door. The hook, which has an angular J shape, is designed to be fitted over the top edge of such a door while open and to lock in position when the door is closed. All the weight of the ironing board is taken on the hook at a considerable distance above the surface board; therefore, only a small side force caused by the motion of an iron across the surface needs to be accounted for. This side force is transferred to the door by pair of small suction cups which are provided near the lower ends of the vertical angle sections. No permanent, property-damaging fasteners are required for mounting the ironing board. Moreover, since the frame can be hung on a closet door, the ironing board can make use of otherwise wasted space that must be reserved for the swing of the door. Furthermore, the ironing board can easily be stored either on the outside of the closet door for convenience or on the inside surface of the closet to remove it from sight.

A further object of the present invention is to provide an ironing board as characterized above in which there are no obtrusive structures or legs on the underside of the surface board while it is being used. Such a feature not only permits one to hang the ironing board over other furniture but also allows a user to sit down while ironing. Even a person confined to a wheel chair can use the ironing board. Moreover, an ironing board without any structure beneath the surface board permits the use of an unique surface board cover. A cover which is slipped on over the free end of the surface board like a glove and fastened to itself at the end of the board proximate the frame is provided. The cover fits snugly and smoothly across the surface without the use of drawstrings and, therefore, can be easily removed for cleaning. Furthermore, the top and bottom of the cover can be made so that they are interchangeable working surfaces, thereby doubling the life of the cover.

A still further object of the present invention is to provide an ironing board having a surface board and frame which can be folded to form a thin, compact and lightweight package in which the frame protects the cover of the surface board during transport or storage.

DETAILED DESCRIPTION OF THE PREFERRED EMBODIMENT

Figures 1, 2:
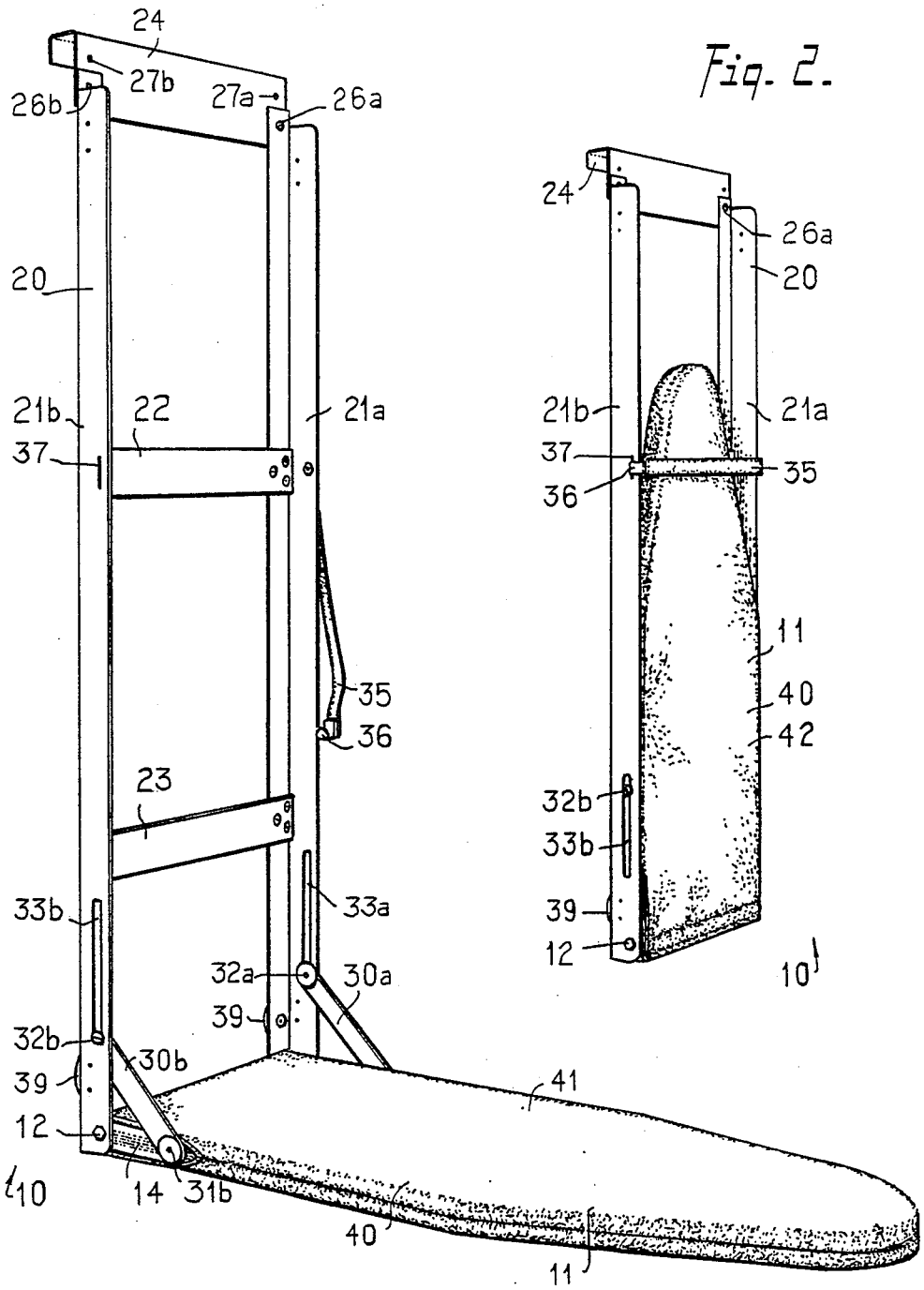
FIG. 1 is a perspective view of the ironing board according to the present invention when the ironing board is in its extended position for use.
FIG. 2 is a perspective view of the ironing board according to FIG. 1 when the ironing board is folded in its storage position.

Referring more specifically to the drawings, a portable, door-hung ironing board is broadly indicated at 10, as illustrated in FIGS. 1–4, the ironing board 10 comprises a surface board 11 having a structure 14 that supports a skin 17 which may be fabricated from preformed metal sheet or like openwork. The structure 14 is pivotally connected to a frame 20 by a pin 12. The frame 20 comprises two vertical support members such as angle sections 21a and 21b and cross members 22 and 23. Means for suspending the frame 20 with its longitudinal centerline disposed generally vertically comprises an elongated hook 24. The mounting hook 24, which is detachably fastened between the upper ends of the angle frame sections 21*a* and 21*b* in such a way as to allow for adjustment of height, has the shape of an inverted J in transverse cross-section and a size and thickness that allows it to be placed over the top edges of a standard closet door and still allow the door to be closed.

Figures 3, 4, 5:
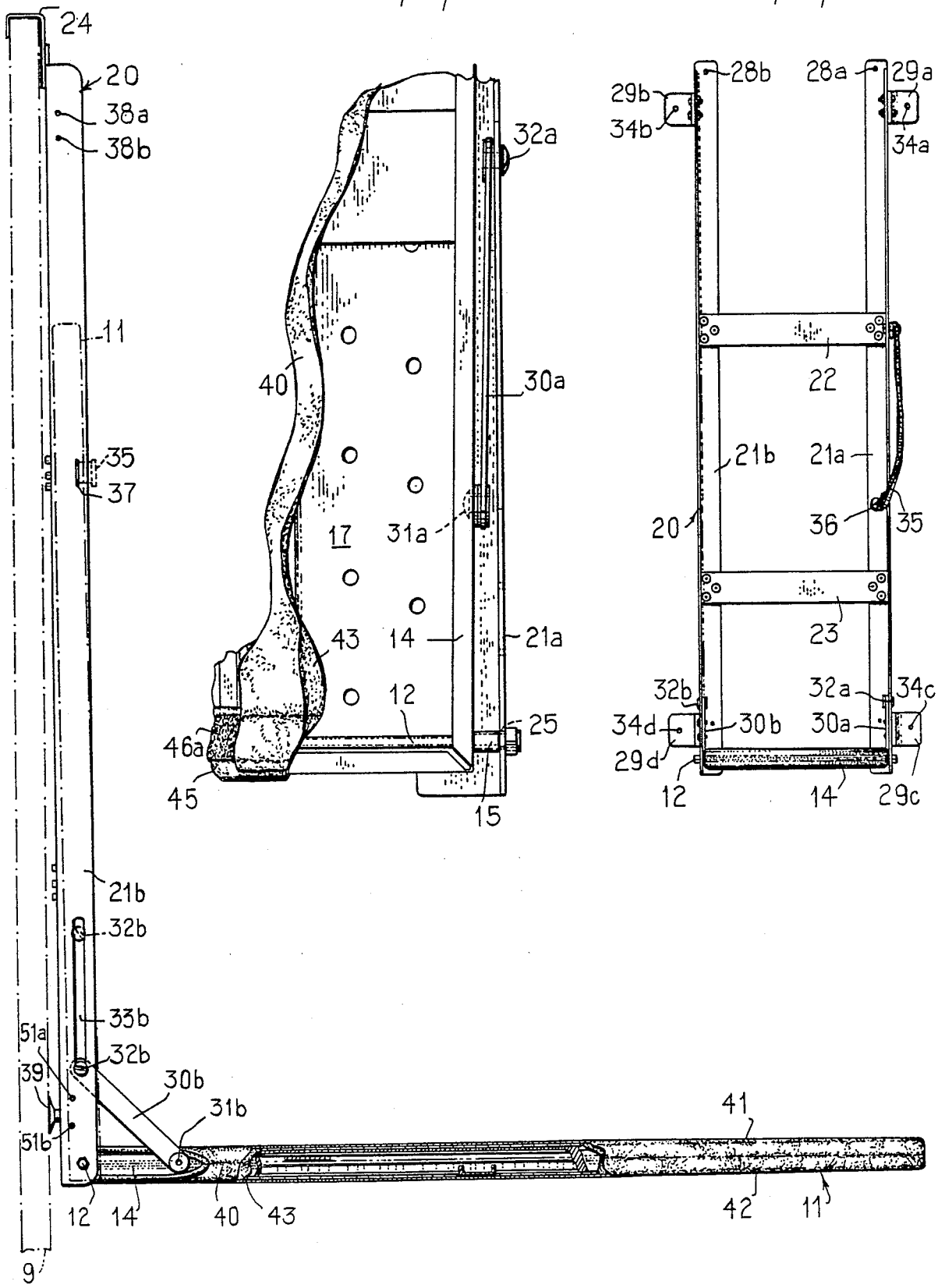
FIG. 3 is a side elevation of the the ironing board according to the present invention showing; partly in cross-section, the surface board extended in its position for use, the dot-dashed lines showing the surface board folded for storage; and a door from which the ironing board is hung.
FIG. 4 is an enlarged frontal view of a fragmentary portion of the lower right corner of the ironing board in its folded storage positions with the cover cut away to show its padded and flap with cloth fastener.
FIG. 5 shows a frontal view of the ironing board, from which the cover has been removed, with its surface board extended, an alternate embodiment for mounting the frame on a door or other vertical surface being illustrated.

The vertical angle section 21a, 21b, which are spaced from and generally parallel to each other, are rigidly connected to the cross members 22, 23 and the mounting hook 24, each of which is disposed with its longitudinal centerline generally perpendicular to the longitudinal centerlines of the sections 21*a*, 21*b*. Holes 25 formed in the vertical angle sections 21*a*, 21*b* are aligned with holes formed in the structure 14 for receiving the pin 12. In the preferred embodiment, the width of the forward branch of each angle section 21*a*, 21*b* is preferably at least as great as the thickness of the surface board 11, so that when the ironing board 10 is folded for storage, the surface board fits without protrusion between the sections 21*a*, 21*b* (FIG. 3).

A pair of braces 30*a*, 30*b* is supplied for transmitting the vertical force of the surface board 11 to the frame 20. One end of each brace is pivotally connected by a pin 31*a*, 31*b* to the structure 14 of the surface board 11; and the other end of each brace is slideably connected to the frame 20 by a pin 32*a*, 32*b* which extends outwardly from the brace end which is received by a slot 33*a*, 33*b* formed in the angle section 21*a*, 21*b*, respectively. The slots 33*a*, 33*b* are of such a length and so positioned that when the pins 31*a*, 31*b* are at the bottom of the slots, the braces 30*a* and 30*b* hold the surface board 11 horizontally and when the pins are at the tops of the slots, the surface board is folded for storage.

When the ironing board 10 is extended in use, the surface board 11 has a small tendency to move away from the door whenever a sufficient side force is developed as the result of friction forces generated by moving an iron across the work surface. Suction cups 39 mounted on the frame 20 with the suction ends of these cups directed toward the vertical surface of the door are employed to transmit the side force to the door itself (FIG. 3). The mounting of the board 10 on the door, therefore, can be accomplished without any detectable damage to the the mounting surface.

When the ironing board 10 is not in use, the surface board 11 is rotated up to the folded position as shown in FIG. 2. An elastic safety strap 35 holds the surface board 11 between the vertical angle sections 21*a* and 21*b* and stops it from extending inadvertently. The strap 35 is fastened at one end to the section 21*a* and has a flat hook 36 that fits into a slot 37 formed in section 21*b*.

In the preferred embodiment, the mounting hook 24 is detachably connected by fasteners 26*a* and 26*b* to the sections 21*a* and 21*b*, respectively. The working height of the ironing board may adjusted by selecting either mounting holes 27*a* and 27*b* or 28*a* and 28*b* to receive the fasteners 26*a* and 26*b*. The inner surfaces of the mounting hook 24 are preferably covered with a cloth material or plastic to keep the hook from marring the surface of the support door 9.

If the user prefers a more permanent mounting arrangement, an alternate embodiment in which the mounting hook 24 is replaced by mounting ears 29*a*, 29*b*, 29*c* and 29*d* is provided (FIG. 5). The mounting ears are fastened to the frame 21 by the use of suitable fasteners inserted in holes 38*a* and 38*b*, 51*a* and 51*b*. Each mounting ear 29*a*, 29*b*, 29*c*, 29*d* itself has a hole 34*a*, 34*b*, 34*c*, 34*d* which can be used to secure the board 10 to a suitable vertical surface; the horizontal separation distance between the centers of the holes 34*a* and 34*b*, 34*c* and 34*d* is preferably about 16 inches for use on standard studded walls.

A special ironing board cover 40 (FIG. 3 & 4) can be used with this ironing board 10 since no obtrusive structural braces or legs are utilized for support. The underside of the surface board 11 is as free from obstruction as its upper surface; and therefore, a cover that slips on like a glove may be utilized. As illustrated in FIG. 4, a flap 45 of the cover 40 extends over the end of the surface board 11 proximate its pivot with the frame 20. A face (not shown) of a Velcro (TM) - type fastener on the underside of the flap 45 which meshes with a strip 46a on a portion of the cover 40 which it overlaps is provided so that the cover can be attached to itself. The cover 40 preferably has two working surfaces 41, 42 both backed by padding 43 allowing the cover to have twice as long a lifetime as a standard one working surface ironing board cover.

It is claimed:

1. In an ironing board having an elongated, flat, rigid structure with a rounded off, pointed toe end and a broad heel end, said heel end being pivotally mounted on a supporting frame which is suspended generally vertically, wherein the improvement comprises: the frame having substantially the same thickness as the structure, the structure being rotatable about a pivot into a position inside the frame in which the longitudinal centerlines of the structure end of the frame are aligned generally parallel with each other, so that when the structure is folded inside the frame the bulk of the structure does not protrude therefrom; and means for bracing the structure so that the structure can be held in a horizontal position when the frame is suspended generally vertically, the bracing means being disposed generally upwardly of the underside of the structure so that space beneath said structure is free for other uses, the bracing means having at least one brace, a first end of the brace being pivotally attached to said structure near the heel end and a second end of the brace being slidably connected to the supporting frame by a pin mounted on the second end, the pin being moveable along an elongated slot formed in the supporting frame, the pin having reached its full travel at the bottom of the slot when the structure is disposed generally horizontally.

2. In an ironing board according to claim 1 wherein the improvement further comprises the frame adapted to be hung from a door and wherein the improvement further comprises means for suspending the frame from the top of the door without rigidly fastening the frame to the door.

3. In an ironing board according to claim 1 wherein the improvement further comprises means for securing the structure when it is rotated inside the frame so that the structure can be held in said position.

4. In an ironing board according to claim 1 wherein the improvement further comprises a tubular spaced cover that has first and second interchangeable ironing surfaces and that may be slipped over said toe end like a glove and pulled to said heel end, the first ironing surface being disposed below said elongated, flat rigid structure when the second ironing surface is disposed above said structure.

5. In an ironing board according to claim 4 wherein the improvement further comprises the tubular cover having first and second portions, the first portion extending over the heel end and overlapping the second portion, so that the cover may be attached to itself.

6. In an ironing board having an elongated, flat, rigid structure with a toe end and a heel end, said heel end being pivotally mounted on a supporting frame which is suspended generally vertically, wherein the improvement comprises: means for bracing the structure so that the structure can be held in a horizontal position when the frame is suspended generally vertically, the bracing means being disposed generally upwardly from the underside of the structure so that space beneath said structure is free for other uses, the bracing means having at least one brace, a first end of the brace being pivotally attached to said structure near the heel end and the second end of the brace being slideably connected to the supporting frame by a pin mounted on the second end, the pin being movable along an elongated slot formed in the supporting frame, the pin having reached its full travel at the bottom of the slot when the structure is disposed generally horizontally.

* * * * *